US008266743B2

(12) United States Patent
Jones et al.

(10) Patent No.: US 8,266,743 B2
(45) Date of Patent: Sep. 18, 2012

(54) EXAMINATION TABLE WITH MOTION TRACKING

(75) Inventors: Chris Jones, Fort Wayne, IN (US); Rodney Hyre, Versailles, OH (US)

(73) Assignee: Midmark Corporation, Versailles, OH (US)

( * ) Notice: Subject to any disclaimer, the term of this patent is extended or adjusted under 35 U.S.C. 154(b) by 183 days.

(21) Appl. No.: 12/861,132

(22) Filed: Aug. 23, 2010

(65) Prior Publication Data

US 2012/0042451 A1 Feb. 23, 2012

(51) Int. Cl.
*A47B 7/02* (2006.01)

(52) U.S. Cl. ..... 5/618; 5/616; 5/617; 5/613

(58) Field of Classification Search ..... 5/616, 617, 5/618, 613

See application file for complete search history.

(56) References Cited

U.S. PATENT DOCUMENTS

| | | | | |
|---|---|---|---|---|
| 3,338,323 | A | 8/1967 | Swersy | |
| 3,723,611 | A | 3/1973 | Hahnkamm et al. | |
| 4,246,734 | A | 1/1981 | Fogle, Jr. et al. | |
| 4,386,298 | A | 5/1983 | Toshimitu | |
| 4,934,468 | A | 6/1990 | Koerber, Sr. et al. | |
| 4,953,244 | A | 9/1990 | Koerber, Sr. et al. | |
| 4,956,592 | A * | 9/1990 | Schulte et al. | 318/560 |
| 5,058,871 | A | 10/1991 | Congin et al. | |
| 5,100,204 | A | 3/1992 | Makihara et al. | |
| 5,197,007 | A * | 3/1993 | Parker | 701/49 |
| 5,297,851 | A | 3/1994 | Van Hekken | |
| 5,491,633 | A | 2/1996 | Henry et al. | |
| 5,544,376 | A | 8/1996 | Fromson | |
| 5,802,640 | A | 9/1998 | Ferrand et al. | |
| 5,861,582 | A | 1/1999 | Flanagan et al. | |
| 5,906,016 | A | 5/1999 | Ferrand et al. | |
| 5,964,455 | A * | 10/1999 | Catanzarite et al. | 267/131 |
| 6,042,187 | A | 3/2000 | Conner et al. | |
| 6,055,877 | A * | 5/2000 | Welterlin et al. | 248/429 |
| 6,168,239 | B1 | 1/2001 | Conner et al. | |
| 6,243,635 | B1 | 6/2001 | Swan et al. | |
| 6,339,302 | B1 * | 1/2002 | Greenbank et al. | 318/103 |
| 6,414,251 | B1 | 7/2002 | Edwards et al. | |
| 6,438,776 | B2 | 8/2002 | Ferrand et al. | |
| 6,590,354 | B2 * | 7/2003 | Hein | 318/34 |
| 6,601,251 | B2 * | 8/2003 | Paul | 5/611 |
| 6,822,571 | B2 | 11/2004 | Conway | |
| 6,926,366 | B2 | 8/2005 | Wolters | |
| 6,941,598 | B2 | 9/2005 | Ferrand et al. | |
| 6,971,131 | B2 * | 12/2005 | Bannister | 5/616 |
| 7,000,911 | B2 | 2/2006 | McCormick et al. | |
| 7,078,630 | B2 | 7/2006 | Martin-Woodin et al. | |
| 7,102,306 | B2 | 9/2006 | Hamaoka et al. | |
| 7,116,100 | B1 | 10/2006 | Mock et al. | |

(Continued)

*Primary Examiner* — Robert G Santos
*Assistant Examiner* — David E Sosnowski
(74) *Attorney, Agent, or Firm* — Wood, Herron & Evans, LLP

(57) ABSTRACT

An examination table includes a support surface movable with respect to a base. The support surface includes a seat portion and a backrest portion. A first motor drives the support surface with respect to the base, and a second motor drives the backrest portion pivotally with respect to the seat portion. A control system includes a control panel and first and second Hall-effect sensors for detecting rotations of the respective first and second motors to determine the current positions of the support surface and the backrest portion. The control system executes a movement algorithm for moving the support surface and the backrest portion to a desired position from the current position. The control system also executes a calibration algorithm for calibrating position tracking of the support surface and the backrest portion.

16 Claims, 10 Drawing Sheets

U.S. PATENT DOCUMENTS

| | | | | |
|---|---|---|---|---|
| 7,125,466 | B2 | 10/2006 | Cooper et al. | |
| 7,156,467 | B2 | 1/2007 | Kimmig | |
| 7,239,096 | B2 * | 7/2007 | Hancock et al. | 318/59 |
| 7,290,836 | B2 | 11/2007 | Nordstrom et al. | |
| 7,319,386 | B2 | 1/2008 | Collins, Jr. et al. | |
| 7,376,991 | B2 | 5/2008 | Stewart et al. | |
| 7,404,221 | B2 | 7/2008 | Sackner | |
| 7,437,787 | B2 | 10/2008 | Bhai | |
| 7,454,805 | B2 * | 11/2008 | Osborne et al. | 5/618 |
| 7,487,562 | B2 * | 2/2009 | Frondorf et al. | 5/613 |
| 8,151,387 | B2 * | 4/2012 | Osborne et al. | 5/618 |
| 8,155,918 | B2 * | 4/2012 | Reed et al. | 702/150 |
| 2001/0029628 | A1 | 10/2001 | Ferrand et al. | |
| 2003/0051292 | A1 | 3/2003 | Ferrand et al. | |
| 2004/0103475 | A1 | 6/2004 | Ogawa et al. | |
| 2004/0251723 | A1 * | 12/2004 | Endo et al. | 297/284.1 |
| 2005/0247494 | A1 | 11/2005 | Montagnino | |
| 2006/0107462 | A1 | 5/2006 | Unger | |
| 2006/0150333 | A1 | 7/2006 | Harding | |
| 2006/0176158 | A1 * | 8/2006 | Fleming | 340/425.5 |
| 2006/0208549 | A1 * | 9/2006 | Hancock et al. | 297/342 |
| 2007/0163045 | A1 | 7/2007 | Becker et al. | |
| 2007/0164619 | A1 * | 7/2007 | Greene | 310/68 B |
| 2007/0210917 | A1 | 9/2007 | Collins et al. | |
| 2008/0094207 | A1 | 4/2008 | Collins et al. | |
| 2008/0289108 | A1 * | 11/2008 | Menkedick et al. | 5/610 |
| 2010/0123302 | A1 * | 5/2010 | Bujak et al. | 280/735 |

* cited by examiner

EXAMINATION TABLE WITH MOTION TRACKING

TECHNICAL FIELD

This invention relates generally to examination tables for medical procedures, and more specifically, to a control system for tracking and controlling the position and movement of an examination table.

BACKGROUND

Examination tables are incorporated in medical offices for supporting or positioning a patient undergoing a medical procedure or examination. Conventional examination tables include a base and a support surface mounted on the base. In order to provide a more comforting support arrangement for the patient, the support surface may include a seat portion and a backrest portion that pivots with respect to the seat portion. Thus, the support surface can be moved from a chair position where the support surface resembles a chair to an examination position where the support surface resembles a substantially flat and elevated examination table, depending upon the current needs of the patient and user.

Conventional examination tables also typically include an actuation system for moving the support surface and the backrest portion. The support surface is moved vertically by a scissor lift or another lifting mechanism incorporated into the base of the examination table. The backrest portion of the support surface may be pivoted with respect to the seat portion with a lift cylinder or another similar drive mechanism. The lifting and drive mechanisms of the actuation system are independently driven by electric motors, hydraulic motors, or other types of motors. Conventional examination tables also include a control system operatively connected to hand-operated and/or foot-operated control panels provided on the examination table. The control system receives input from the control panels and then activates the motors of the actuation system to move the support surface or the backrest portion.

The control system of conventional examination tables typically is programmed to respond only to user commands directed to moving one of the motors in a certain direction. In other words, the control panel of these conventional examination tables only includes buttons to actuate movement of the support surface in one direction or pivoting of the backrest portion in one direction. Therefore, to move between the chair position to the examination position, a user has to individually push multiple buttons on the control panel until the support surface and the backrest portion are driven to the desired location. This is an inefficient use of a user's time, especially for a medical professional.

Additionally, many conventional examination tables do not track the position of the support surface and the backrest portion in any manner. For those conventional examination tables that do track the position of the support surface and the backrest portion, potentiometer position sensors are directly coupled to the support surface and the backrest portion to detect movement and track the position of the examination table. These potentiometers must be physically calibrated to the examination table's range of motion so that the position of the examination table can be accurately determined. Furthermore, these potentiometers are unreliable over extended periods of time, thereby requiring numerous physical calibrations of the position tracking system. It would be desirable to provide an examination table that overcomes these and other deficiencies.

SUMMARY

The invention according to one embodiment includes an examination table having a base and a support surface mounted on the base, the support surface having a seat portion and a backrest portion. The examination table also includes a first motor for driving the support surface with respect to the base, and a second motor for driving the backrest portion with respect to the seat portion. The examination table includes a control system having a control panel with a first button. The control system further includes a first Hall-effect sensor for detecting rotations of the first motor to determine a current position of the support surface, and a second Hall-effect sensor for detecting rotations of the second motor to determine a current position of the backrest portion.

When the first button on the control panel is actuated, the control system executes a one-touch movement algorithm for moving the support surface and the backrest portion to a desired position from the current position. The movement algorithm is configured to detect the current position of the support surface and actuate the first motor until the support surface has moved to the desired position. The movement algorithm is also configured to detect the current position of the backrest portion and actuate the second motor until the backrest portion has moved to the desired position. The desired position may correspond to an examination position or a chair position of the examination table.

In another embodiment, an examination table includes a base and a support surface mounted on the base, the support surface having a seat portion and a backrest portion. The examination table also includes a first motor for driving the support surface between a distal position and a proximal position with respect to the base, and a second motor for driving the backrest portion between a first position and a second position with respect to the seat portion. The examination table includes a control system having a control panel with a calibration button. The control system further includes a first Hall-effect sensor for detecting rotations of the first motor, and a second Hall-effect sensor for detecting rotations of the second motor.

When the calibration button on the control panel is actuated, the control system executes a calibration algorithm for calibrating position tracking of the support surface and the backrest portion. The calibration algorithm is configured to actuate the first motor to drive the support surface to the proximal position and set a Base Position Variable Minimum to zero at the proximal position. The calibration algorithm is also configured to actuate the first motor to drive the support surface to the distal position and set a Base Position Variable Maximum to a number of first motor rotations detected by the first Hall-effect sensor during the movement of the support surface to the distal position. The calibration algorithm is further configured to actuate the second motor to drive the backrest portion to the first position and set a Backrest Position Variable Minimum to zero at the first position. The calibration algorithm is also configured to actuate the second motor to drive the backrest portion to the second position and set a Backrest Position Variable Maximum to a number of second motor rotations detected by the second Hall-effect sensor during the movement of the backrest portion to the second position.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION

Figure 1:
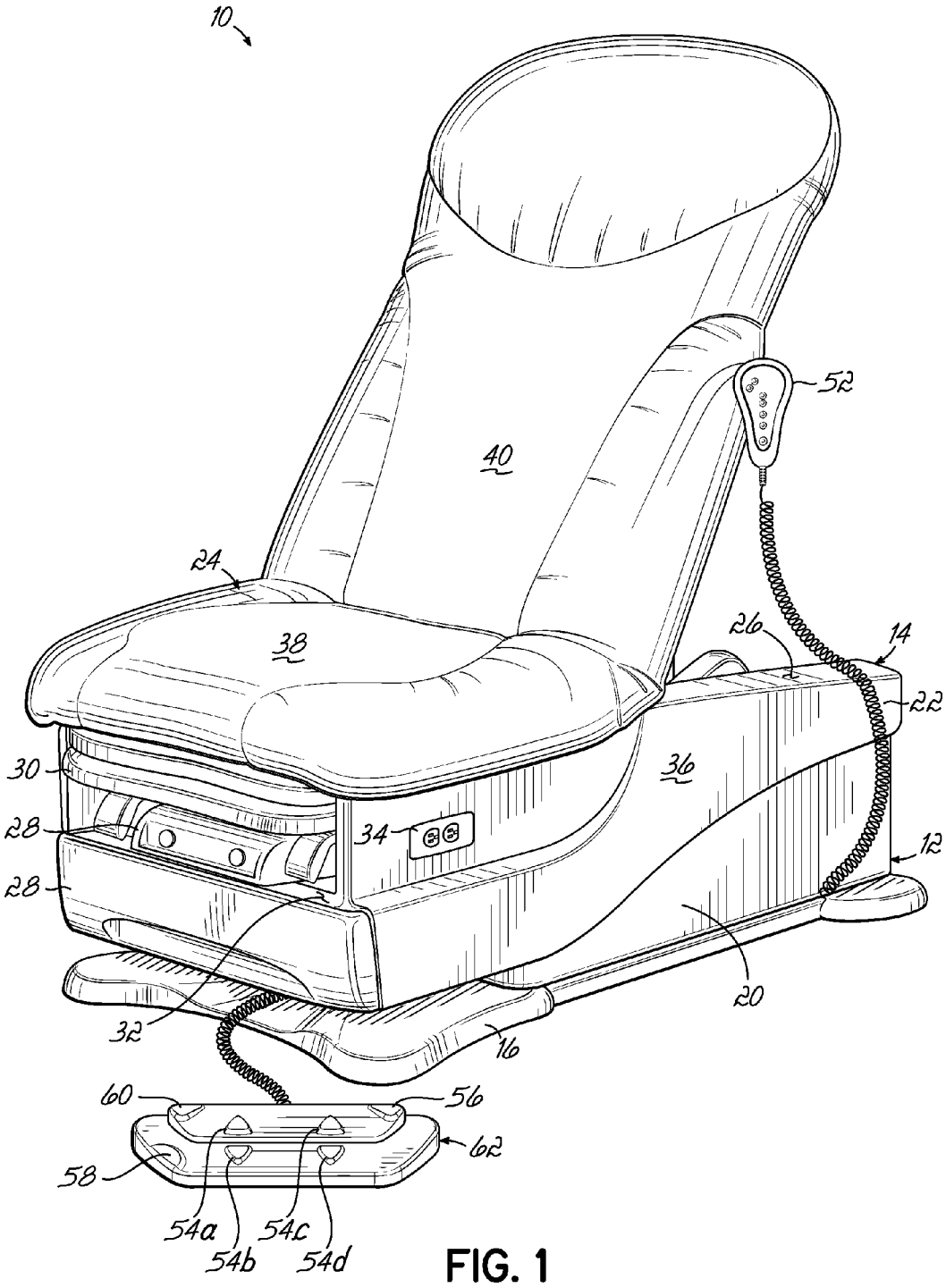
FIG. 1 is a perspective view of one embodiment of an examination table in accordance with the invention.
Figure 2:
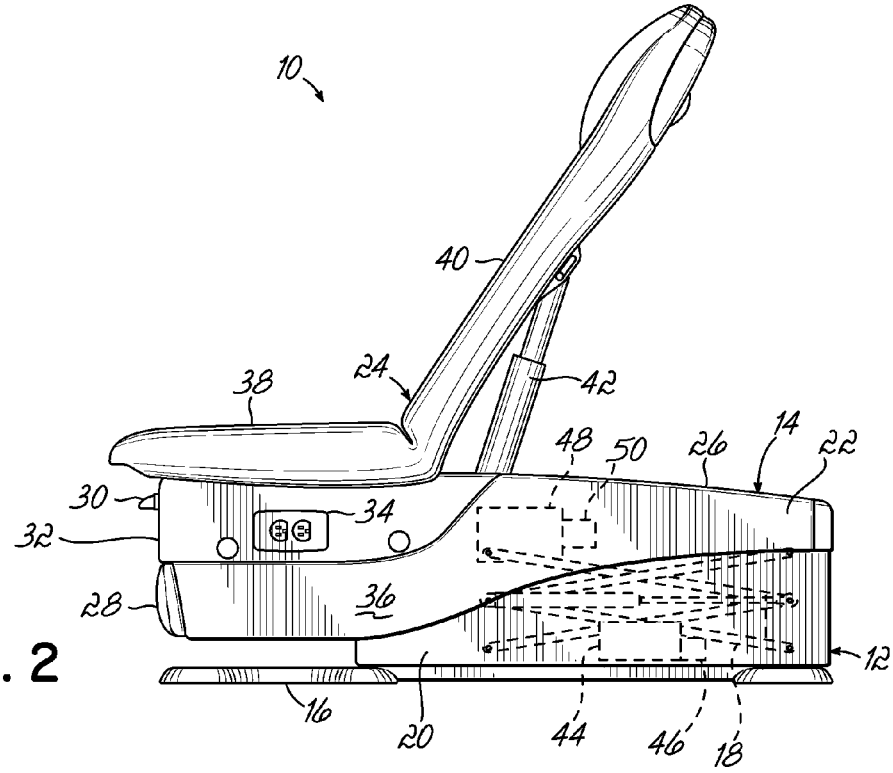
FIG. 2 is a side view of the examination table of FIG. 1, illustrating the actuation system of the examination table.
Figure 4:
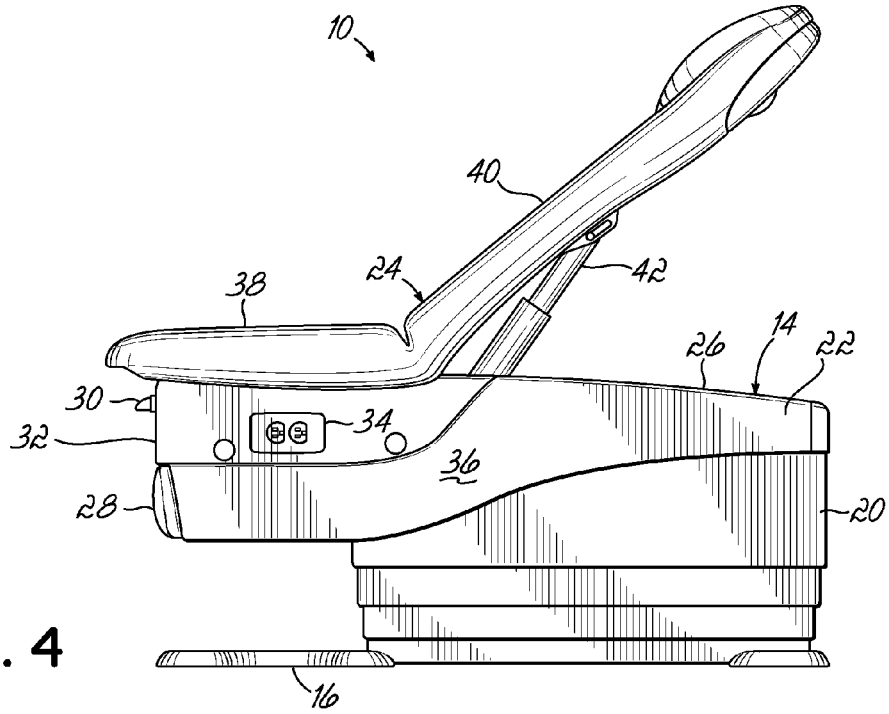
FIG. 4 is a side view of the examination table of FIG. 1 in an initial position.

Referring to FIGS. 1-4, one embodiment of an examination table 10 is illustrated. The examination table 10 includes a base portion 12 and a table portion 14 disposed above the base portion 12. The base portion 12 includes a base member 16 for supporting the examination table 10 on a floor surface. The base portion 12 also includes a scissor lift 18 (shown in phantom in FIG. 2) engaged with the base member 16 and the table portion 14. The scissor lift 18 is operable to move the table portion 14 generally upwardly and downwardly with respect to the base member 16. The scissor lift 18 and all other internal components of the base portion 12 are stored within a telescoping shell cover 20. The telescoping shell cover 20 telescopes outwardly from the base member 16 to the table portion 14.

The table portion 14 further includes a table frame 22 and a support surface 24. The table frame 22 defines a generally planar upper surface 26 for supporting the support surface 24. The table frame 22 may also include a plurality of storage drawers 28 and retractable instrument pans 30 at a front surface 32 of the table frame 22. The storage drawers 28 and retractable instrument pans 30 provide convenient storage areas for a user such as a medical professional during patient examinations and procedures on the examination table 10. The table frame 22 further includes at least one electrical outlet 34 positioned along a side surface 36 of the table frame 22. The electrical outlet 34 is powered by the power supply to the examination table 10 and permits convenient electrical power for accessory devices used with the examination table 10 or during a medical procedure.

The support surface 24 is divided into a seat portion 38 and a backrest portion 40. The support surface 24 is generally padded or cushioned to more comfortably accommodate a patient. The seat portion 38 is rigidly coupled to the upper surface 26 of the table frame 22 adjacent to the front surface 32. The backrest portion 40 extends behind the seat portion 38 and may be pivoted with respect to the seat portion 38. A lift cylinder 42 or similar device is engaged with the backrest portion 40 and the table frame 22 to pivot the backrest portion 40. The lift cylinder 42 and scissor lift 18 combine to form an actuation system for moving the examination table 10 through various positions such as the initial position shown in FIG. 4. It will be appreciated that various other lifting mechanisms could be substituted for the scissor lift 18 and the lift cylinder 42 in other embodiments.

The actuation system also includes a first motor 44 operatively coupled to the scissor lift 18 and a control system (not illustrated) of the examination table 10. The first motor 44 drives the scissor lift 18 to move the table portion 14 and support surface 24 between a proximal position with respect to the base member 16 and a distal position with respect to the base member 16. The first motor 44 is a brushless direct current (DC) electric motor in the illustrated embodiment, but a hydraulic motor or another type of motor may be used in other embodiments. The control system includes a first Hall-effect sensor 46 coupled to or incorporated into the first motor 44. As the first motor 44 rotates, a magnet of the first Hall-effect sensor 46 rotates with the first motor 44 and thereby modifies a localized magnetic field in the vicinity of the first motor 44. The first Hall-effect sensor 46 includes a current-carrying electrical circuit that is affected by these changes in the localized magnetic field, and thus, the first Hall-effect sensor 46 can detect full rotations of the first motor 44. In some embodiments, a plurality of first Hall-effect sensors 46 may be used to determine partial rotations of the first motor 44.

The actuation system of the examination table 10 further includes a second motor 48 operatively coupled to the lift cylinder 42 and the control system. The second motor 48 drives the lift cylinder 42 to move the backrest portion 40 of the support surface 24 between a first position adjacent to the table frame 22 and a second position angled upwardly from the table frame 22 and seat portion 38. The second motor 48 is also a brushless direct current (DC) electric motor in the illustrated embodiment. The control system includes a second Hall-effect sensor 50 coupled to or incorporated into the second motor 48. The second Hall-effect sensor 50 operates in an identical manner as the first Hall-effect sensor 46 to detect rotations of the second motor 48. The first and second Hall-effect sensors 46, 50 provide motor rotation information to the control system, and the control system actuates the first and second motors 44, 48 in accordance with these sensed rotations.

Figure 3:
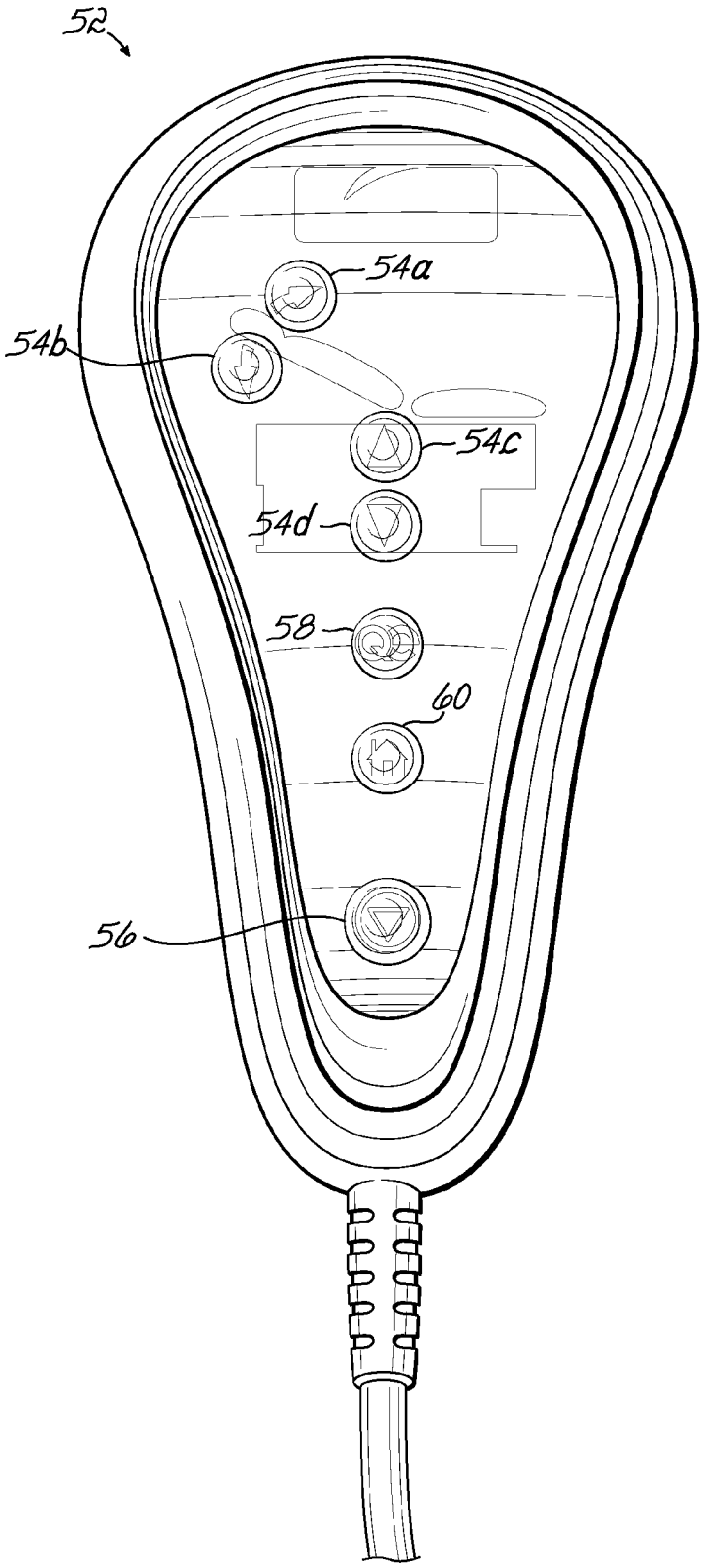
FIG. 3 is a front view of the hand control panel of the examination table of FIG. 1.
Figure 5:
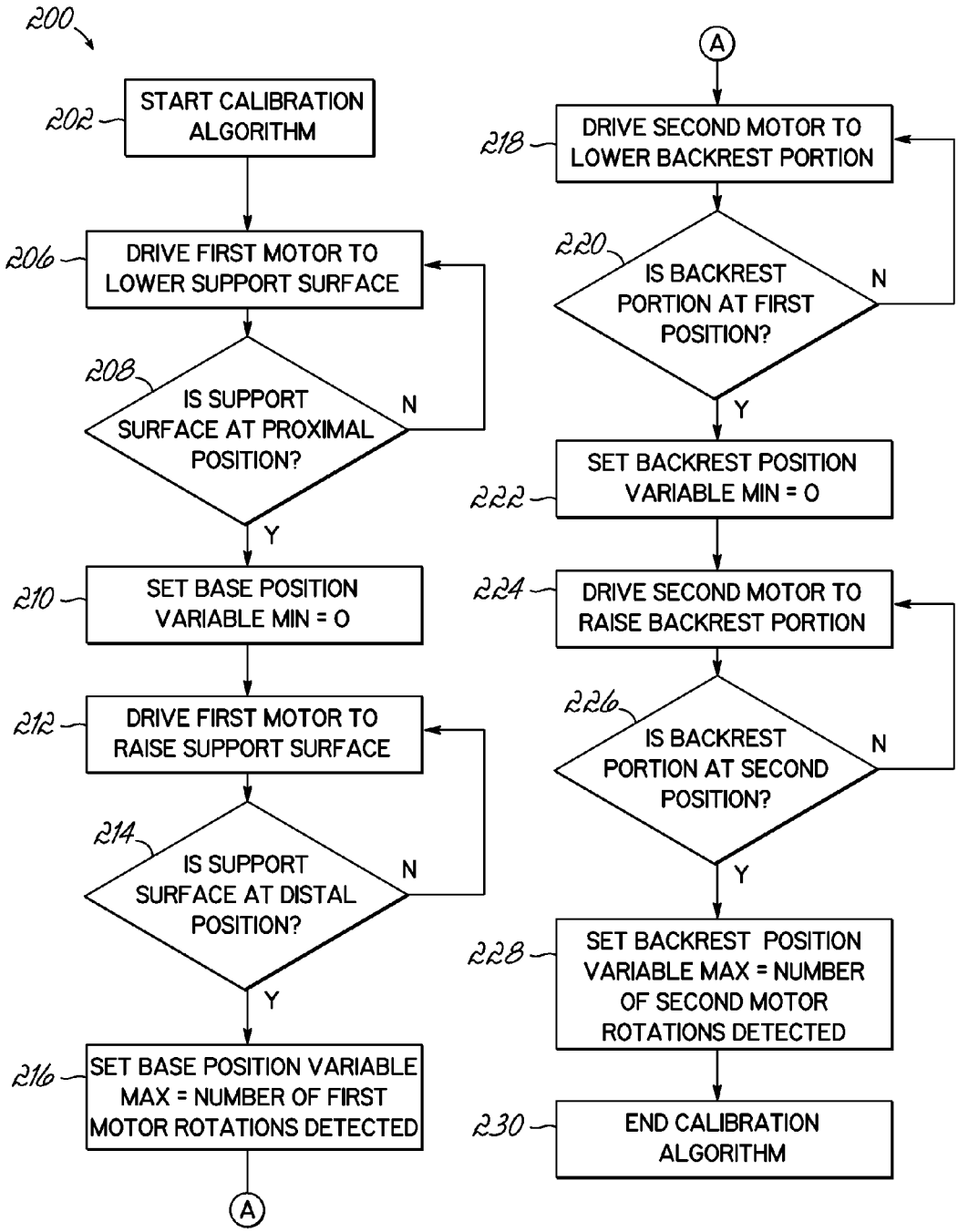
FIG. 5 is a flowchart schematically illustrating the calibration algorithm of the examination table of FIG. 1.

The control system of the examination table 10 further includes a control panel 52 as shown in FIGS. 1 and 3. The control panel 52 is configured to be held in a user's hand, and may be stored on the backrest portion 40 when not in use. The control panel 52 includes a plurality of buttons for controlling the operation of the actuation system. The control panel 52 includes a set of manual control buttons 54*a*, 54*b*, 54*c*, 54*d* for individually driving the first and second motors 44, 48 in a certain direction. Thus, the first manual control button 54*a* causes the second motor 48 to drive the backrest portion 40 upwardly toward the second position, while the second manual control button 54*b* causes the second motor 48 to drive the backrest portion 40 downwardly toward the first position. Similarly, the third manual control button 54*c* causes the first motor 44 to drive the support surface 24 upwardly toward the distal position, and the fourth manual control button 54*d* causes the first motor 44 to drive the support surface 24 downwardly toward the proximal position.

The control panel 52 also includes a calibration button 56 that actuates the execution of a calibration algorithm 200 of the control system, as will be described in further detail below. The control panel 52 illustrated in FIG. 3 includes a first button 58 and a second button 60 for actuating the control system to execute a one-touch movement algorithm 400 described in further detail below. For example, the movement algorithm 400 automatically moves the examination table 10 to a desired position, such as an examination position or a chair position, with only one touch of the first or second button 58, 60. Although the first and second buttons 58, 60 are labeled "QC" for Quick Chair and "Home" in FIG. 3, more generic labels may be used if the desired positions are reprogrammed.

As shown in FIG. 1, the examination table 10 may further include a foot control panel 62 similar in operation to the hand-held control panel 52. The foot control panel 62 includes corresponding "manual" control buttons 54*a*, 54*b*, 54*c*, 54*d*, a calibration button 56, and first and second buttons 58, 60 for actuating the movement algorithm 400. The foot control panel 62 allows a medical professional to move the examination table 10 without hands, thereby allowing an examination or medical procedure to continue seamlessly.

FIGS. 5 and 6A-6D illustrate the calibration algorithm 200 executed by the control system of the examination table 10. The calibration algorithm 200 is started when a user presses the calibration button 56 on the control panel 52 (at step 202). It will be appreciated that when the examination table 10 is powered up, control variables indicating the current position of the base member 16 or support surface 24 (entitled Base Position Variable) and the current position of the backrest portion 40 (entitled Backrest Position Variable) are retrieved from a non-volatile memory unit (not shown) for use in the following-described algorithms. The control system actuates the first motor 44 to lower the support surface 24 with respect to the base member 16 (at step 206). This movement of the support surface 24 is indicated by arrows 64 in FIG. 6A. The calibration algorithm 200 then checks to see if the support surface 24 is at the proximal position shown in FIG. 6A (at step 208). If not, the first motor 44 continues to lower the support surface 24. Once the support surface 24 reaches the proximal position, the calibration algorithm 200 sets a Base Position Variable Minimum to zero motor rotations (at step 210).

Next, the control system actuates the first motor 44 to raise the support surface 24 with respect to the base member 16 (at step 212). This movement of the support surface 24 is shown by arrows 66 in FIG. 6B. The calibration algorithm 200 then checks to see if the support surface 24 is at the distal position illustrated in FIG. 6B (at step 214). If not, the first motor 44 continues to raise the support surface 24. Once the support surface 24 reaches the distal position, the calibration algorithm 200 sets a Base Position Variable Maximum to the number of first motor rotations detected by the first Hall-effect sensor 46 during the movement of the support surface 24 from the proximal position to the distal position (at step 216).

Then, the control system actuates the second motor 48 to lower the backrest portion 40 toward the table frame 22 (at step 218). This movement of the backrest portion 40 is indicated by arrow 68 in FIG. 6C. The calibration algorithm 200 then checks to see if the backrest portion 40 is at the first position shown in FIG. 6C (at step 220). If not, the second motor 48 continues to lower the backrest portion 40. Once the backrest portion 40 reaches the first position, the calibration algorithm 200 sets the Backrest Position Variable Minimum to zero motor rotations (at step 222).

The control system subsequently actuates the second motor 48 to raise the backrest portion 40 away from the table frame 22 (at step 224). This movement of the backrest portion 40 is shown by arrow 70 in FIG. 6D. The calibration algorithm 200 then checks to see if the backrest portion 40 is at the second position illustrated in FIG. 6D (at step 224). If not, the second motor 48 continues to raise the backrest portion 40. Once the backrest portion 40 reaches the second position, the calibration algorithm 200 sets the Backrest Position Variable Maximum to the number of second motor rotations detected by the second Hall-effect sensor 50 during the movement of the backrest portion 40 from the first position to the second position (at step 228). At this point, the calibration algorithm 200 has defined the total range of motion for the examination table 10, and the calibration algorithm 200 ends (at step 230).

Figure 6A:
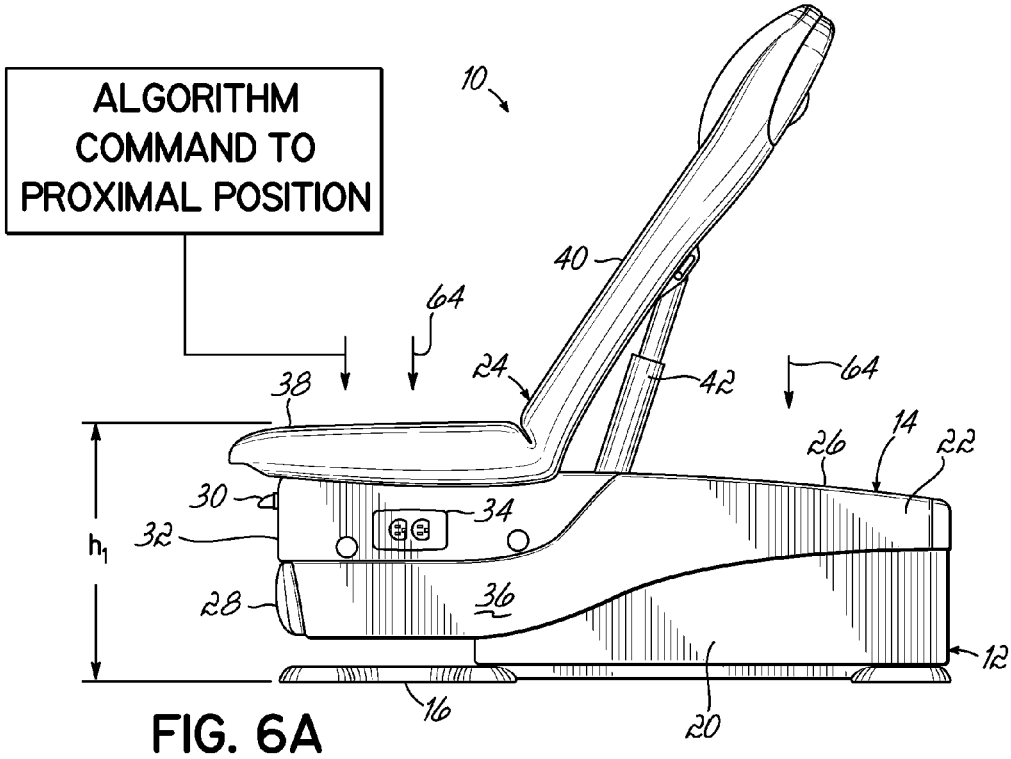
FIG. 6A is a side view of the examination table of FIG. 1 during a first portion of the execution of the calibration algorithm of FIG. 5.
Figure 6B:
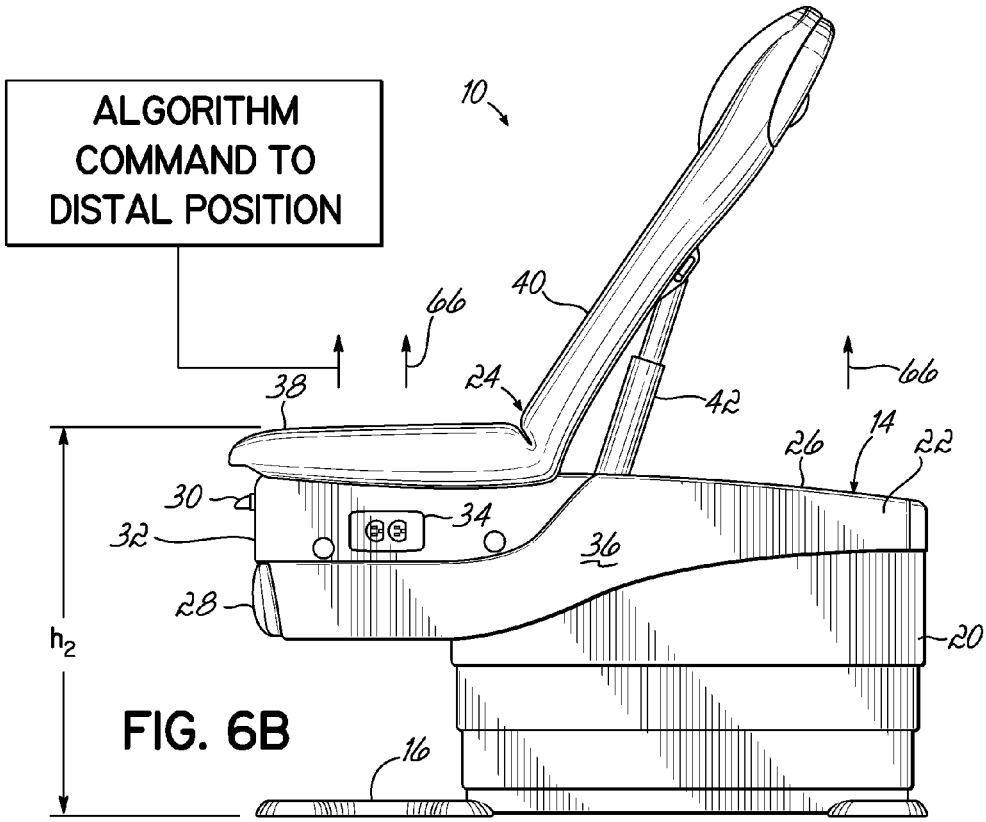
FIG. 6B is a side view of the examination table of FIG. 1 during a second portion of the execution of the calibration algorithm of FIG. 5.
Figure 6C:
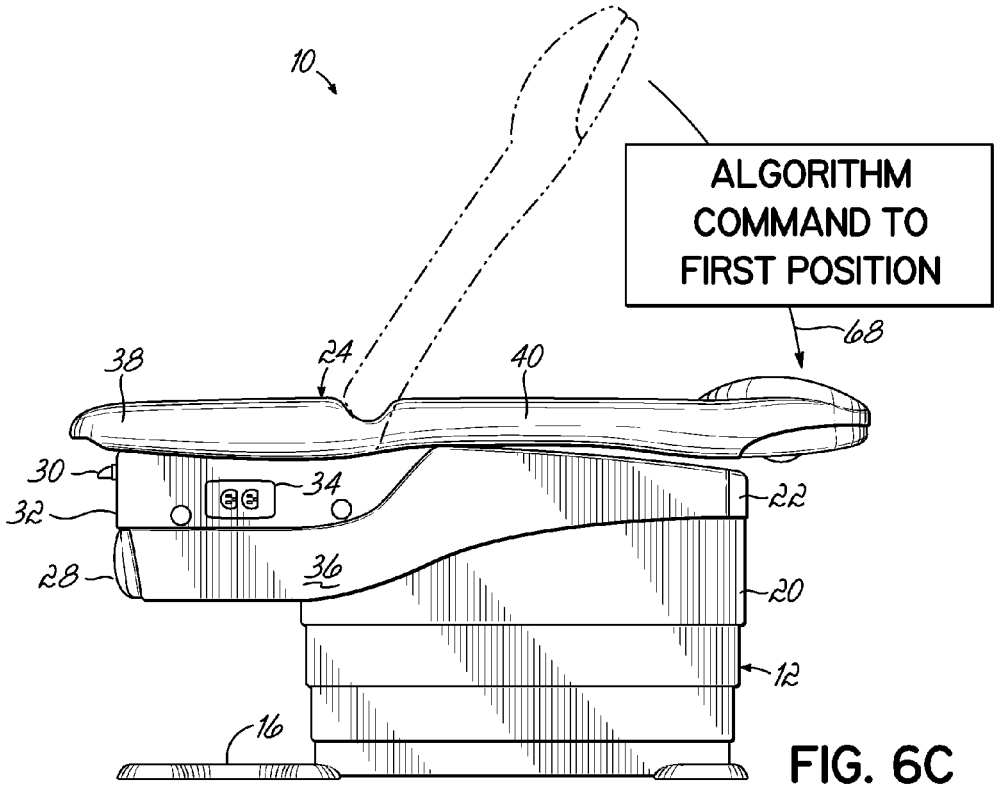
FIG. 6C is a side view of the examination table of FIG. 1 during a third portion of the execution of the calibration algorithm of FIG. 5.
Figure 6D:
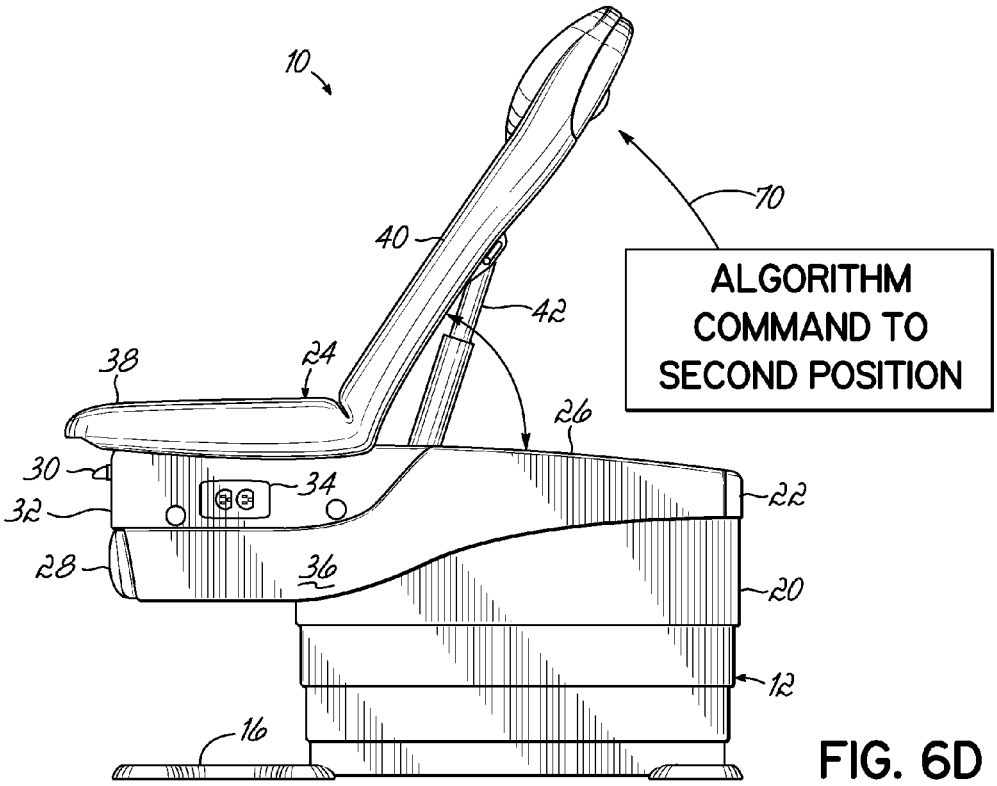
FIG. 6D is a side view of the examination table of FIG. 1 during a fourth portion of the execution of the calibration algorithm of FIG. 5.

As shown in FIGS. 6A-6D, the range of motion for the examination table 10 is also defined by the height of the support surface 24 from a floor surface and the angle of inclination of the backrest portion 40 with respect to the seat portion 38. In the illustrated embodiment, the minimum height $h_1$ of the support surface 24 in the proximal position of FIG. 6A is about 18 inches. The maximum height $h_2$ of the support surface 24 in the distal position of FIG. 6B is about 37 inches. The control system can correlate the range of motion from $h_1$ to $h_2$ to a discrete number of motor rotations of the first motor 44. Also in the illustrated embodiment, the minimum angle of the backrest portion 40 in the first position of FIG. 6C is about 0 degrees, while the maximum angle $\alpha$ of the backrest portion 40 in the second position of FIG. 6D is about 80 degrees. Again, the control system can correlate the range of motion of the backrest portion 40 to a discrete number of motor rotations of the second motor 48. Thus, motion tracking of the examination table 10 by the control system is enabled as further described below.

Figure 7A:
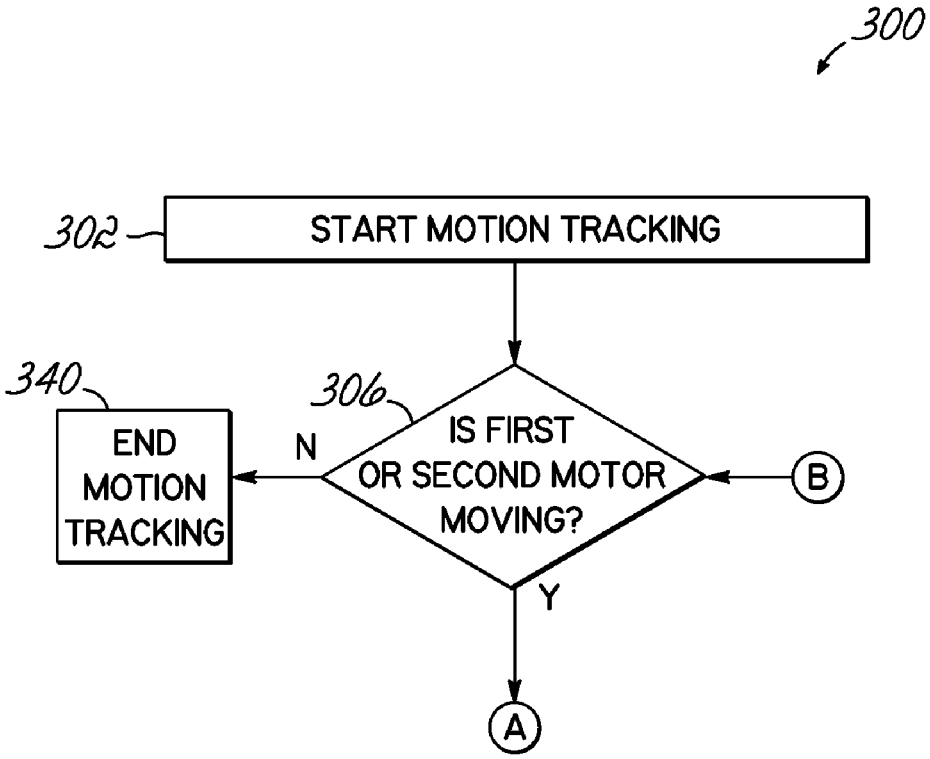
FIGS. 7A and 7B are a flowchart schematically illustrating the motion tracking of the examination table of FIG. 1.
Figure 7B:
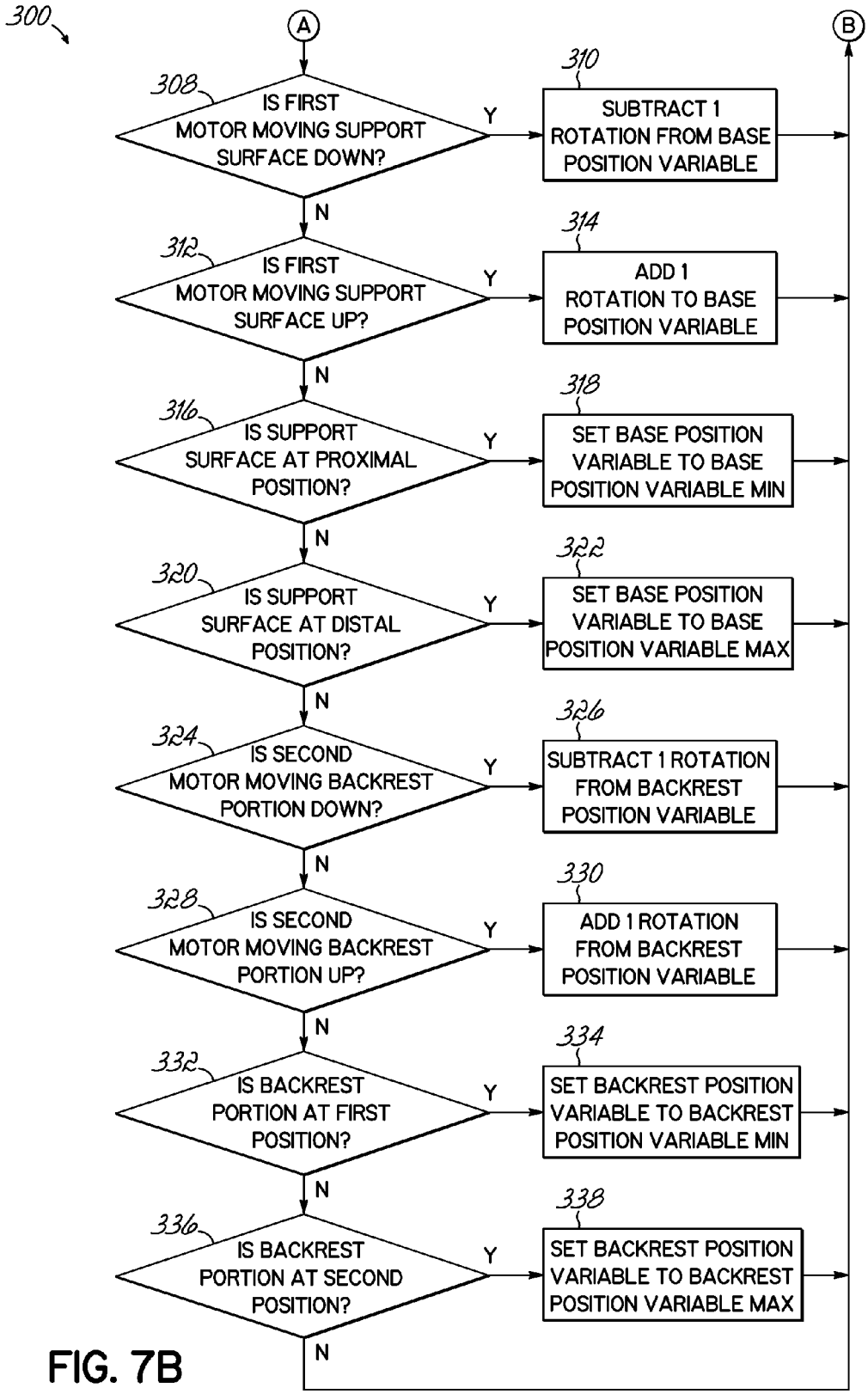

The control system of the examination table 10 continuously executes a motion tracking algorithm 300 when the examination table 10 is moving. The motion tracking algorithm 300 is schematically illustrated in the flowchart of FIGS. 7A and 7B. Once the examination table 10 is powered on, the motion tracking algorithm 300 begins (at step 302). As previously described, on powering up the examination table 10, the control system retrieves the current Base Position Variable and the current Backrest Position Variable from non-volatile memory.

The motion tracking algorithm 300 determines if either the first motor 44 or the second motor 48 is moving (at step 306). If so, then the motion tracking algorithm 300 determines if the first motor 44 is moving the support surface 24 downward (at step 308). If the first motor 44 is moving the support surface 24 downward, the control system subtracts one rotation from the Base Position Variable (at step 310) and the motion tracking algorithm 300 returns to step 306. If the first motor 44 is not moving the support surface downward, the motion tracking algorithm 300 determines if the first motor 44 is moving the support surface 24 upward (at step 312). If the first motor 44 is moving the support surface 24 upward, the control system adds one rotation to the Base Position Variable (at step 314) and the motion tracking algorithm 300 returns to step 306.

If the first motor 44 is not moving the support surface upward, the motion tracking algorithm 300 determines if the support surface 24 is at the proximal position shown in FIG. 6A (at step 316). If the support surface 24 is at the proximal position, the control system sets the Base Position Variable equal to the Base Position Variable Minimum from the calibration algorithm 200 (at step 318) and the motion tracking algorithm 300 returns to step 306. If the support surface 24 is not at the proximal position, the motion tracking algorithm 300 determines if the support surface 24 is at the distal position shown in FIG. 6B (at step 320). If the support surface 24 is at the distal position, the control system sets the Base Position Variable equal to the Base Position Variable Maximum from the calibration algorithm 200 (at step 322) and the motion tracking algorithm 300 returns to step 306.

The motion tracking algorithm 300 next determines if the second motor 48 is moving the backrest portion 40 downward (at step 324). If the second motor 48 is moving the backrest portion 40 downward, the control system subtracts one rotation from the Backrest Position Variable (at step 326) and the motion tracking algorithm 300 returns to step 306. If the second motor 48 is not moving the backrest portion 40 downward, the motion tracking algorithm 300 determines if the second motor 48 is moving the backrest portion 40 upward (at step 328). If the second motor 48 is moving the backrest portion upward, the control system adds one rotation to the Backrest Position Variable (at step 330) and the motion tracking algorithm 300 returns to step 306.

If the second motor 48 is not moving the backrest portion upward, the motion tracking algorithm 300 determines if the backrest portion 40 is at the first position shown in FIG. 6C (at step 332). If the backrest portion 40 is at the first position, the control system sets the Backrest Position Variable equal to the Backrest Position Variable Minimum from the calibration algorithm 200 (at step 334) and the motion tracking algorithm 300 returns to step 306. If the backrest portion 40 is not at the first position, the motion tracking algorithm 300 determines if the backrest portion 40 is at the second position shown in FIG. 6D (at step 336). If the backrest portion 40 is at the second position, the control system sets the Backrest Position Variable equal to the Backrest Position Variable Maximum from the calibration algorithm 200 (at step 338) and the motion tracking algorithm 300 returns to step 306

If the backrest portion 40 is not at the second position, the motion tracking algorithm 300 returns to step 306. At step 306, if the first and second motors 44, 48 are not moving, the motion tracking algorithm ends (at step 340). Consequently, every movement of the examination table 10 is tracked by the control system and the current position of the examination table 10 is always known thanks to the calibration of the motion tracking described above.

Figure 8:
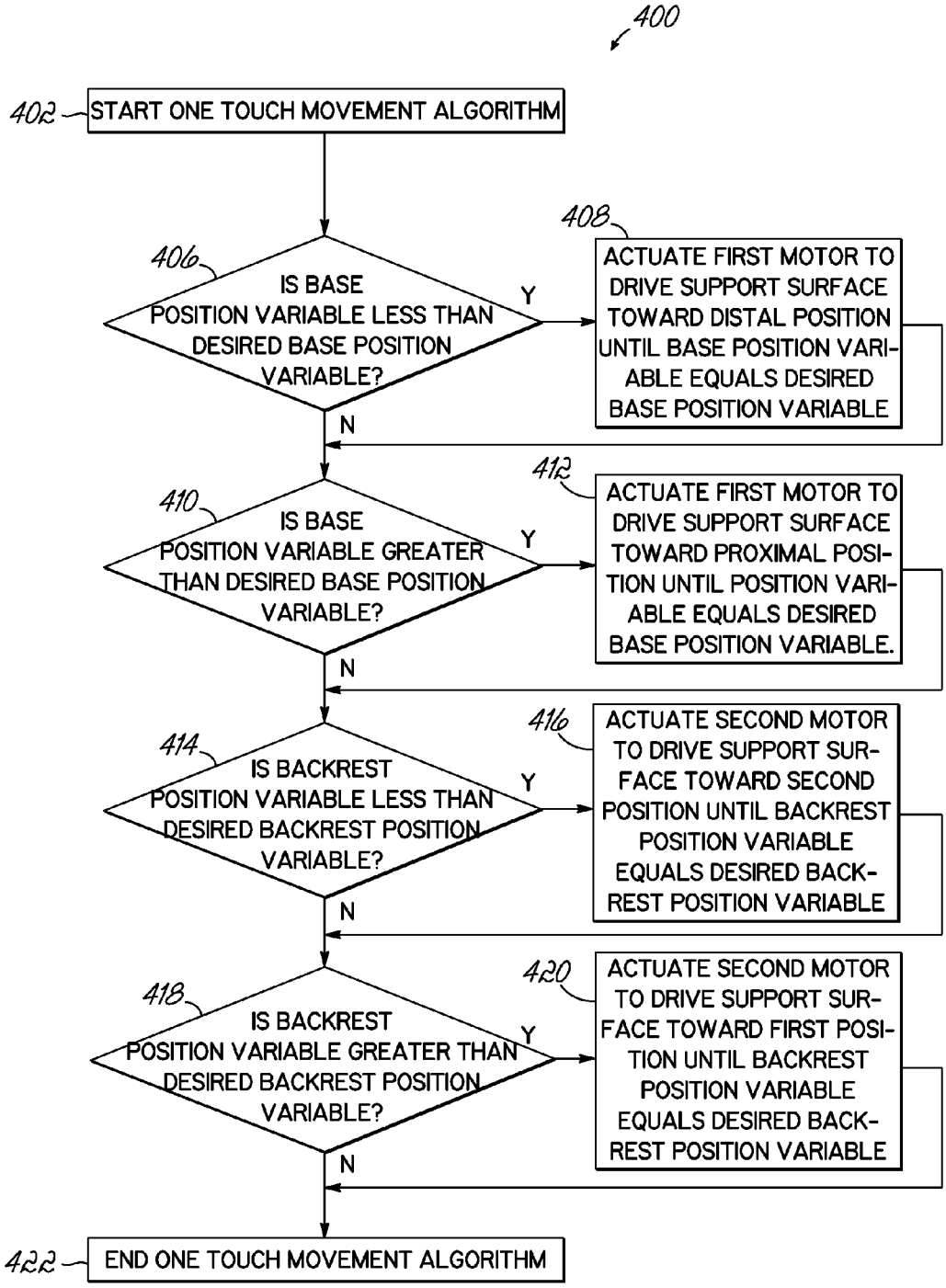
FIG. 8 is a flowchart schematically illustrating the one-touch movement algorithm of the examination table of FIG. 1.

A one-touch movement algorithm 400 executed by the control system of the examination table 10 is schematically illustrated in FIG. 8. If the first button 58 or the second button 60 on the control panel 52 is pressed, the control system begins executing the movement algorithm 400 (at step 402). It will be appreciated that when the examination table 10 is powered up, control variables indicating the desired position of the base member 16 or support surface 24 (entitled Desired Base Position Variable) and the desired position of the backrest portion 40 (entitled Desired Backrest Position Variable) are retrieved from a non-volatile memory unit (not shown) for use in the following-described algorithm.

The one-touch movement algorithm 400 determines if the Base Position Variable is less than the Desired Base Position Variable (at step 406). If the Base Position Variable is less than the Desired Base Position Variable, the control system actuates the first motor 44 to drive the support surface 24 upward toward the distal position (at step 408) and then stops the first motor 44 at the desired base position when the Base Position Variable is equal to the Desired Base Position Variable. If the Base Position Variable is not less than the Desired Base Position Variable, the movement algorithm 400 determines if the Base Position Variable is greater than the Desired Base Position Variable (at step 410). If the Base Position Variable is greater than the Desired Base Position Variable, the control system actuates the first motor 44 to drive the support surface 24 downward toward the proximal position (at step 412), and then stops the first motor 44 at the desired base position when the Base Position Variable is equal to the Desired Base Position Variable.

If the Base Position Variable is not greater than the Desired Base Position Variable, the one-touch movement algorithm 400 determines if the Backrest Position Variable is less than the Desired Backrest Position Variable (at step 414). If the Backrest Position Variable is less than the Desired Backrest Position Variable, the control system actuates the second motor 48 to drive the backrest portion 40 upward toward the second position (at step 416), and then stops the second motor 48 at the desired base position when the Backrest Position Variable is equal to the Desired Backrest Position Variable. If the Backrest Position Variable is not less than the Backrest Position Variable, the movement algorithm 400 determines if the Backrest Position Variable is greater than the Desired Backrest Position Variable (at step 418). If the Backrest Position Variable is greater than the Desired Backrest Position Variable, the control system actuates the second motor 48 to drive the backrest portion 40 downward toward the first position (at step 420), and then stops the second motor 48 at the desired base position when the Backrest Position Variable is equal to the Desired Backrest Position Variable.

Figure 9A:
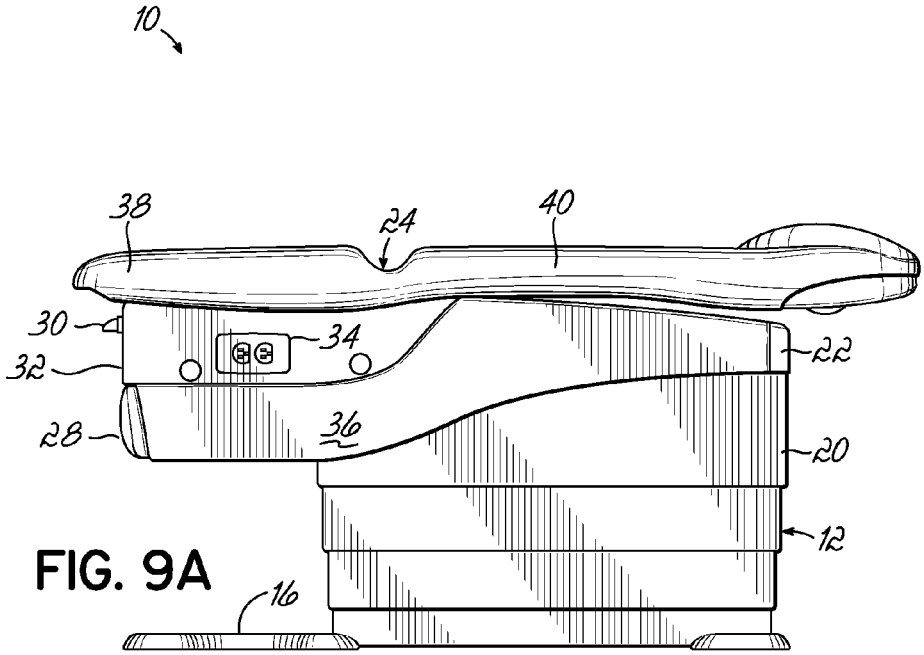
FIG. 9A is a side view of the examination table of FIG. 1 after the execution of the one-touch movement algorithm of FIG. 8 to a first desired position.
Figure 9B:
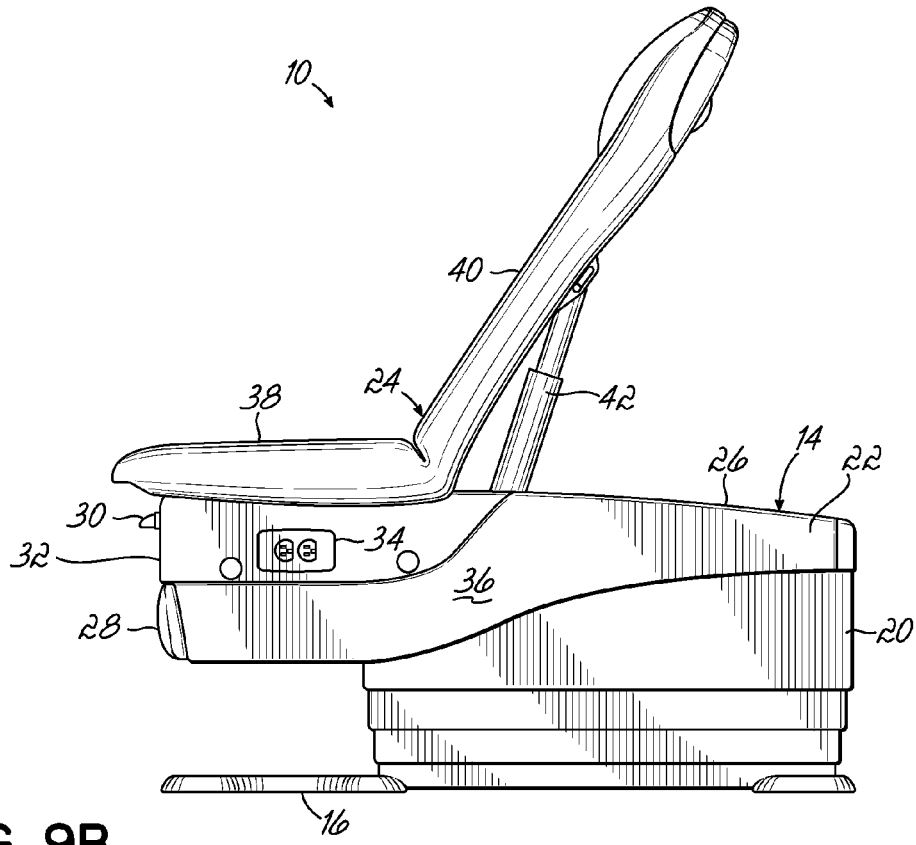
FIG. 9B is a side view of the examination table of FIG. 1 after the execution of the one-touch movement algorithm of FIG. 8 to a second desired position.

If the Backrest Position Variable is not greater than the Desired Backrest Position Variable at step 418, then the movement algorithm 400 ends (at step 422). Thus, the movement algorithm 400 ensures that the current position of the support surface 24 and the backrest portion 40 are the pre-programmed desired positions of the support surface 24 and the backrest portion 40, as evidenced by the Base Position Variable and the Backrest Position Variable being equal to the Desired Base Position Variable and the Desired Backrest Position Variable, respectively. For example, the first button 58 on the control panel 52 may execute a movement algorithm 400 that moves the examination table 10 to a desired position corresponding to an examination position illustrated in FIG. 9A (support surface 24 elevated, backrest portion 40 reclined). In another example, the second button 60 on the control panel 52 may execute a movement algorithm 400 that moves the examination table 10 to a second desired position corresponding to an chair position illustrated in FIG. 9B (support surface 24 lowered, backrest portion 40 inclined).

Thus, the examination table 10 illustrated in FIGS. 1-9B enables virtual calibration of motion tracking for the entire range of motion for the support surface 24 and the backrest portion 40. Additionally, the examination table 10 enables one-touch movement to any of a number of pre-programmed desired positions. The examination table 10 allows a medical professional to easily reposition the examination table 10 as needed without interrupting the flow of a medical examination or medical procedure.

While the present invention has been illustrated by the description of the embodiment thereof, and while the embodiment has been described in considerable detail, it is not the intention of the applicant to restrict or in any way limit the scope of the appended claims to such detail. Additional advantages and modifications will readily appear to those skilled in the art. For example, additional buttons may be added to the control panel 52 and programmed to move the examination table 10 to various additional desired positions. Therefore, the invention in its broader aspects is not limited to the specific details representative apparatus and method, and illustrative examples shown and described.

Accordingly, departures may be made from such details without departure from the spirit or scope of applicant's general inventive concept.

We claim:

1. An examination table, comprising:

a base;

a support surface mounted on the base and including a seat portion and a backrest portion;

a first motor configured to drive the support surface with respect to the base, the first motor including a brushless direct-current electric motor;

a second motor configured to drive the backrest portion with respect to the seat portion, the second motor including a brushless direct-current electric motor; and a control system including a control panel with a first button, a first Hall-effect sensor configured to detect rotations of the first motor to determine a current position of the support surface, and a second Hall-effect sensor configured to detect rotations of the second motor to determine a current position of the backrest portion, wherein each of the first and second Hall-effect sensors includes a magnet coupled to the corresponding first or second motor and includes at least one Hall-effect device sensing rotations of each magnet with the corresponding motor to thereby count rotations of the corresponding motor, and wherein when the first button on the control panel is actuated, the control system executes a movement algorithm for moving the support surface and the backrest portion to a desired position from the current position, the movement algorithm being configured to: (1) detect the current position of the support surface; (2) actuate the first motor until the support surface has moved to the desired position; (3) detect the current position of the backrest portion; and (4) actuate the second motor until the backrest portion has moved to the desired position.

2. The examination table of claim 1, wherein the desired position corresponds to an examination position of the examination table.

3. The examination table of claim 1, wherein the desired position corresponds to a chair position of the examination table.

4. The examination table of claim 1, wherein the control panel further includes a second button that may be pressed by a user to execute the movement algorithm to move the support surface and the backrest portion to a second desired position.

5. The examination table of claim 1, wherein the control panel further includes a set of manual-control buttons for individually actuating one of the first and second motors in a certain direction.

6. An examination table, comprising:

a base;

a support surface mounted on the base and including a seat portion and a backrest portion;

a first motor configured to drive the support surface between a distal position and a proximal position with respect to the base, the first motor including a brushless direct-current electric motor;

a second motor configured to drive the backrest portion to pivot between a first position and a second position with respect to the seat portion, the second motor including a brushless direct-current electric motor; and a control system including a control panel with a calibration button, a first Hall-effect sensor configured to detect rotations of the first motor, and a second Hall-effect sensor configured to detect rotations of the second motor, wherein each of the first and second Hall-effect sensors includes a magnet coupled to the corresponding first or second motor and includes at least one Hall-effect device sensing rotations of each magnet with the corresponding motor to thereby count rotations of the corresponding motor, and wherein when the calibration button on the control panel is actuated, the control system executes a calibration algorithm for calibrating position tracking of the support surface and the backrest portion, the calibration algorithm being configured to: (1) actuate the first motor to drive the support surface to the proximal position; (2) set a Base Position Variable Minimum to zero at the proximal position; (3) actuate the first motor to drive the support surface to the distal position; (4) set a Base Position Variable Maximum to a number of first motor rotations detected by the first Hall-effect sensor during the movement of the support surface to the distal position; (5) actuate the second motor to drive the backrest portion to the first position; (6) set a Backrest Position Variable Minimum to zero at the first position; (7) actuate the second motor to drive the backrest portion to the second position; and (8) set a Backrest Position Variable Maximum to a number of second motor rotations detected by the second Hall-effect sensor during the movement of the backrest portion to the second position.

7. The examination table of claim 6, wherein the control system determines a current position of the support surface by detecting how many first motor rotations the first motor has traveled from the proximal position.

8. The examination table of claim 7, wherein the control system determines a current position of the backrest portion by detecting how many second motor rotations the second motor has traveled from the first position.

9. The examination table of claim 8, wherein the control panel includes a first button configured to actuate the control system to execute a movement algorithm for moving the support surface and the backrest portion to a desired position from the current position, the movement algorithm being configured to: (1) detect the current position of the support surface; (2) actuate the first motor until the support surface has moved to the desired position; (3) detect the current position of the backrest portion; and (4) actuate the second motor until the backrest portion has moved to the desired position.

10. The examination table of claim 9, wherein the control system sets a Base Position Variable equal to the number of first motor rotations the first motor has traveled from the proximal position, and wherein the movement algorithm is configured to (1) actuate the first motor to drive the support surface toward the proximal position if the Base Position Variable for the current position is greater than the Base Position Variable for the desired position; and (2) actuate the first motor to drive the support surface toward the distal position if the Base Position Variable for the current position is less than the Base Position Variable for the desired position.

11. The examination table of claim 9, wherein the control system sets a Backrest Position Variable equal to the number of second motor rotations the first motor has traveled from the first position, and wherein the movement algorithm is configured to (1) actuate the second motor to drive the backrest portion toward the first position if the Backrest Position Variable for the current position is greater than the Backrest Position Variable for the desired position; and (2) actuate the second motor to drive the backrest portion toward the second position if the Backrest Position Variable for the current position is less than the Backrest Position Variable for the desired position.

12. The examination table of claim 6, wherein the control panel further includes a set of manual-control buttons for individually actuating one of the first and second motors in a certain direction.

13. A method for operating an examination table, comprising:

receiving input from a calibration button on a control panel of the examination table, the examination table further comprising a base; a support surface mounted on the base and including a seat portion and a backrest portion; a first motor configured to drive the support surface between a distal position and a proximal position with respect to the base; a second motor configured to drive the backrest portion to pivot between a first position and a second position with respect to the seat portion; and a control system including a first Hall-effect sensor configured to detect rotations of the first motor and a second Hall-effect sensor configured to detect rotations of the second motor, wherein each of the first and second Hall-effect sensors includes a magnet coupled to the corresponding first or second motor and includes at least one Hall-effect device sensing rotations of each magnet with the corresponding motor to thereby count rotations of the corresponding motor, and operating the examination table to perform a series of operations defining a calibration algorithm in response to the received input from the calibration button, the series of operations including:

actuating the first motor to drive the support surface to the proximal position;

setting a Base Position Variable Minimum to zero at the proximal position;

actuating the first motor to drive the support surface to the distal position;

setting a Base Position Variable Maximum to a number of first motor rotations detected by the first Hall-effect sensor during movement of the support surface from the proximal position to the distal position;

actuating the second motor to drive the backrest portion to the first position;

setting a Backrest Position Variable Minimum to zero at the first position;

actuating the second motor to drive the backrest portion to the second position; and setting a Backrest Position Variable Maximum to a number of second motor rotations detected by the second Hall-effect sensor during movement of the backrest portion from the first position to the second position.

14. The method of claim 13, further comprising:

determining a current position of the support surface by detecting how many rotations the first motor has traveled from the proximal position and setting a Base Position Variable equal to the number of rotations of the first motor; and determining a current position of the backrest portion by detecting how many rotations the second motor has traveled from the first position and setting a Backrest Position Variable equal to the number of rotations of the second motor.

15. The method of claim 14, further comprising:

storing a Desired Base Position Variable and a Desired Backrest Position Variable corresponding to a desired position of the examination table;

receiving input from a desired position button on the control panel of the examination table; and operating the examination table to perform a series of operations defining a movement algorithm in response to the received input from the desired position button, the series of operations including:

detecting the current position of the support surface by retrieving the Base Position Variable;

actuating the first motor to drive the support surface toward the desired position until the Base Position Variable equals the Desired Base Position Variable;

detecting the current position of the backrest portion by retrieving the Backrest Position Variable;

actuating the second motor to drive the backrest portion toward the desired position until the Backrest Position Variable equals the Desired Backrest Position Variable.

16. The method of claim 14, wherein during movement of the support surface or of the backrest portion, the method further comprises:

setting the Base Position Variable to zero each time the first motor has driven the support surface to the proximal position;

setting the Base Position Variable to the Base Position Variable Maximum each time the first motor has driven the support surface to the distal position;

setting the Backrest Position Variable to zero each time the second motor has driven the backrest portion to the first position; and setting the Backrest Position Variable to the Backrest Position Variable Maximum each time the second motor has driven the backrest portion to the second position.

* * * * *